US011198318B2

(12) United States Patent
Schacht et al.

(10) Patent No.: US 11,198,318 B2
(45) Date of Patent: Dec. 14, 2021

(54) METHODS FOR MANUFACTURING PANELS AND PANEL OBTAINED THEREBY

(71) Applicant: FLOORING INDUSTRIES LIMITED, SARL, Bertrange (LU)

(72) Inventors: Benny Schacht, Vlamertinge (BE); Filip Tack, Oudenaarde (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

(21) Appl. No.: 17/224,548

(22) Filed: Apr. 7, 2021

(65) Prior Publication Data

US 2021/0221166 A1 Jul. 22, 2021

Related U.S. Application Data

(60) Continuation of application No. 14/990,819, filed on Jan. 8, 2016, which is a division of application No.
(Continued)

(30) Foreign Application Priority Data

Mar. 10, 2009 (BE) ..... 2009/0141
Apr. 21, 2009 (BE) ..... 2009/0246

(51) Int. Cl.
*B05D 1/32* (2006.01)
*B44C 5/04* (2006.01)
(Continued)

(52) U.S. Cl.
CPC ..... *B44C 5/04* (2013.01); *B05D 1/322* (2013.01); *B05D 3/06* (2013.01); *B05D 3/12* (2013.01);
(Continued)

(58) Field of Classification Search
CPC . B05D 1/32; B05D 3/06; B05D 3/061; B05D 1/322; B05D 1/26; B05D 5/02; B05D 7/06; B44C 5/04; B44C 5/043
See application file for complete search history.

(56) References Cited

U.S. PATENT DOCUMENTS 1,971,067 A 8/1934 Fess
3,173,804 A 3/1965 Standfuss
(Continued)

FOREIGN PATENT DOCUMENTS

DE 2721292 A1 11/1978
DE 2856391 A1 7/1980
(Continued)

*Primary Examiner* — Nathan H Empie
(74) *Attorney, Agent, or Firm* — Capitol City TechLaw

(57) ABSTRACT

A method may be provided for manufacturing coated panels of the type including at least a substrate and a top layer with a motif. The top layer may be provided on the substrate. The method may involve providing a synthetic material layer on the substrate. A relief may be provided on the surface of said synthetic material layer provided on the substrate. The relief may include a pattern of recesses. The pattern may be at least partially determined by at least one print that is applied by inkjet printing. The relief may be obtained by printing a mask directly on or in the synthetic material layer. After providing the mask, the synthetic material layer may be cured. The mask may provide for selective curing of the synthetic material layer, such that the synthetic material layer is not solidified or solidified at a lesser extent in correspondence of the mask. The not solidified or less solidified portions of the synthetic material layer may be removed by performing a material-removing treatment on the synthetic material layer thereby obtaining the relief.

14 Claims, 5 Drawing Sheets

Related U.S. Application Data

13/139,546, filed as application No. PCT/IB2009/055148 on Nov. 18, 2009, now Pat. No. 9,266,382, said application No. 13/139,546 is a continuation-in-part of application No. PCT/IB2009/054968, filed on Nov. 9, 2009.

(60) Provisional application No. 61/139,286, filed on Dec. 19, 2008.

(51) Int. Cl.

| | |
|---|---|
| ***B44C 1/10*** | (2006.01) |
| ***B44C 1/22*** | (2006.01) |
| ***E04F 13/08*** | (2006.01) |
| ***E04F 15/02*** | (2006.01) |
| ***B05D 7/06*** | (2006.01) |
| ***B05D 5/06*** | (2006.01) |
| ***B05D 5/02*** | (2006.01) |
| ***B05D 3/12*** | (2006.01) |
| ***B05D 3/06*** | (2006.01) |
| ***B44C 1/20*** | (2006.01) |
| *B05D 1/26* | (2006.01) |

(52) U.S. Cl.

CPC ..... *B05D 5/02* (2013.01); *B05D 5/065* (2013.01); *B05D 7/06* (2013.01); *B44C 1/10* (2013.01); *B44C 1/20* (2013.01); *B44C 1/22* (2013.01); *B44C 5/043* (2013.01); *B44C 5/0453* (2013.01); *E04F 13/08* (2013.01); *E04F 15/02* (2013.01); *E04F 15/02033* (2013.01); *B05D 1/26* (2013.01)

(56) References Cited

U.S. PATENT DOCUMENTS

| | | | | |
|---|---|---|---|---|
| 3,293,094 | A | 12/1966 | Nairn et al. | |
| 3,399,106 | A | 8/1968 | Palmer et al. | |
| 3,434,861 | A | 3/1969 | Luc | |
| 3,547,659 | A | 12/1970 | Cort | |
| 3,554,827 | A | 1/1971 | Yamagishi | |
| 3,674,611 | A | 7/1972 | Petry et al. | |
| 3,810,774 | A | 5/1974 | Pittman | |
| 3,811,915 | A | 5/1974 | Burrell et al. | |
| 3,905,849 | A | 9/1975 | Bomboire | |
| 4,050,409 | A | 9/1977 | Duchenaud et al. | |
| 4,097,635 | A | 6/1978 | Sanz Hernandez et al. | |
| 4,233,343 | A | 11/1980 | Barker et al. | |
| 4,298,646 | A | 11/1981 | Haemer et al. | |
| 4,397,896 | A | 8/1983 | Moran | |
| 5,082,495 | A | 1/1992 | Iijima | |
| 5,916,662 | A | 6/1999 | Schmidt | |
| 6,444,018 | B1 * | 9/2002 | King | C09D 11/34 106/31.13 |
| 6,477,948 | B1 | 11/2002 | Nissing et al. | |
| 6,979,487 | B2 | 12/2005 | Scarbrough et al. | |
| 6,991,830 | B1 | 1/2006 | Hansson et al. | |
| 8,465,804 | B2 | 6/2013 | Provoost et al. | |
| 2001/0022607 | A1 | 9/2001 | Takahashi et al. | |
| 2002/0114927 | A1 | 8/2002 | Brossman et al. | |
| 2002/0142106 | A1 | 10/2002 | Bethune et al. | |
| 2003/0138618 | A1 | 7/2003 | Courtoy et al. | |
| 2003/0159385 | A1 | 8/2003 | Thiers | |
| 2004/0026017 | A1 | 2/2004 | Taylor et al. | |
| 2004/0086678 | A1 | 5/2004 | Chen et al. | |
| 2004/0146806 | A1 * | 7/2004 | Roberts | G03F 7/033 430/287.1 |
| 2005/0153243 | A1 | 7/2005 | Rundle et al. | |
| 2006/0130421 | A1 | 6/2006 | Nollet et al. | |
| 2006/0280870 | A1 | 12/2006 | Halot et al. | |
| 2007/0084368 | A1 | 4/2007 | Vest et al. | |
| 2008/0011167 | A1 | 1/2008 | Prager et al. | |
| 2008/0172856 | A1 | 7/2008 | Brouckaert et al. | |
| 2014/0196618 | A1 | 7/2014 | Pervan et al. | |

FOREIGN PATENT DOCUMENTS

| | | | | |
|---|---|---|---|---|
| DE | 19532819 | A1 | | 3/1997 |
| DE | 19725829 | C1 | | 8/1998 |
| DE | 202008008597 | U1 | | 9/2008 |
| EP | 0007230 | A2 | | 1/1980 |
| EP | 0130559 | A2 | | 1/1985 |
| EP | 1138467 | A1 | | 10/2001 |
| EP | 1872959 | A1 | | 1/2008 |
| FR | 2827529 | A1 | | 1/2003 |
| GB | 1015701 | A | | 1/1966 |
| GB | 1467899 | A | | 3/1977 |
| JP | 49029950 | B | * | 8/1974 |
| JP | 54-155254 | | | 12/1979 |
| WO | 9747834 | A1 | | 12/1997 |
| WO | 9945060 | A1 | | 9/1999 |
| WO | 0147724 | A1 | | 7/2001 |
| WO | 0147725 | A1 | | 7/2001 |
| WO | 0148333 | A1 | | 7/2001 |
| WO | 0183488 | A1 | | 11/2001 |
| WO | 2004042168 | A1 | | 5/2004 |
| WO | 2005033204 | A1 | | 4/2005 |
| WO | 2006090287 | A1 | | 8/2006 |
| WO | 2007059967 | A1 | | 5/2007 |

* cited by examiner

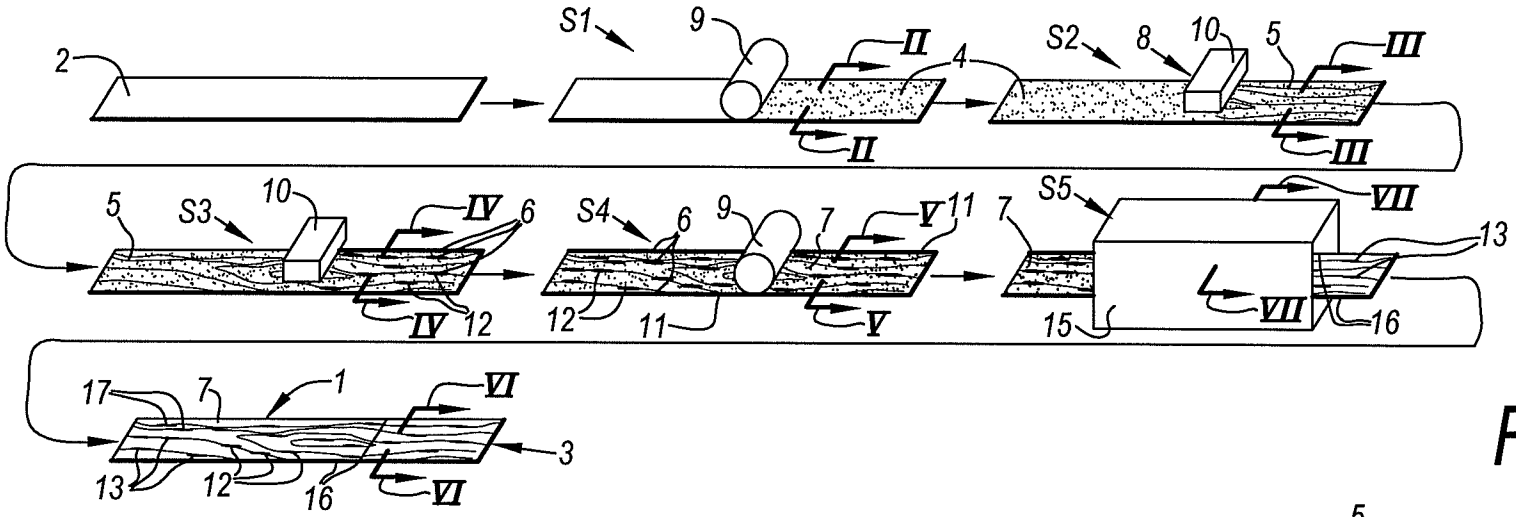
Fig. 1
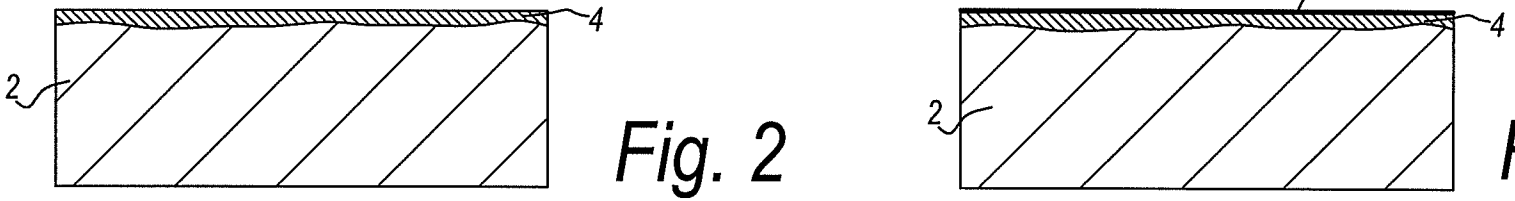
Fig. 2
Fig. 3
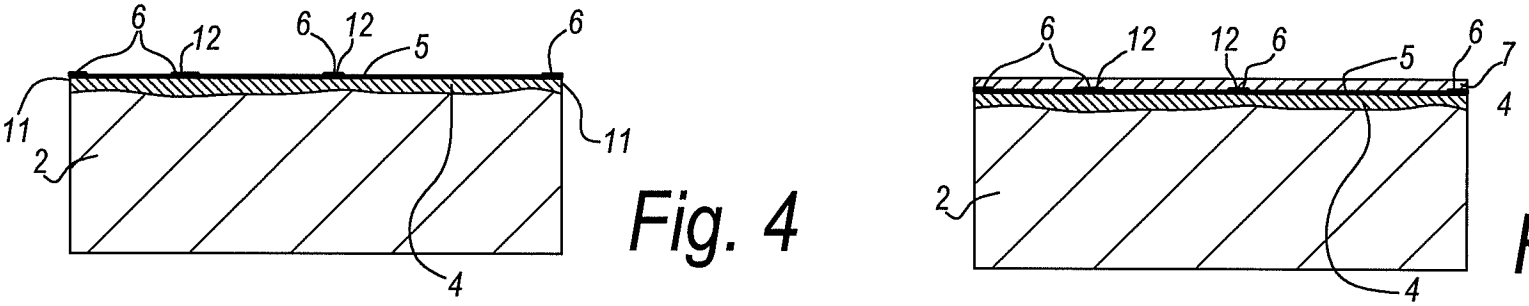
Fig. 4
Fig. 5

METHODS FOR MANUFACTURING PANELS AND PANEL OBTAINED THEREBY

This application is a continuation application of U.S. patent application Ser. No. 14/990,819 filed Jan. 8, 2016, which is a divisional application of U.S. patent application Ser. No. 13/139,546 filed Jun. 14, 2011 (issued as U.S. Pat. No. 9,266,382 on Feb. 23, 2016), which is a US National Phase Application of International Application PCT/IB2009/055148 filed Nov. 18, 2009, which claims priority under 35 USC 119(e) to U.S. Provisional Application No. 61/139,286 filed on Dec. 19, 2008, the entire content of all three of which are incorporated herein by reference.

U.S. patent application Ser. No. 13/139,546 is a continuation-in-part application of International Application PCT/IB2009/054968 filed Nov. 9, 2009, the entire content of which is incorporated herein by reference.

This application claims priority under 35 USC § 119(a)-(d) to Belgian Patent Application Nos. 2009/0141 filed Mar. 10, 2009, and 2009/0246 filed Apr. 21, 2009, the entire content of both of which are incorporated herein by reference.

BACKGROUND

1. Field

This invention relates to methods for manufacturing panels, as well as to panels which can be obtained by such methods.

More particularly, the invention relates to methods for manufacturing panels of the type comprising a least a substrate and a top layer with a motif, said top layer being provided on this substrate. Herein, this may relate, for example, to furniture panels, ceiling panels, floor panels or the like, which substantially consist of a MDF or HDF (Medium or High Density Fiberboard) basic panel or substrate and a top layer provided thereon. In particular, this relates to a method wherein one or more material layers are provided on the substrate, wherein at least one of these material layers comprises a printed motif. Preferably, this relates to a motif which is at least partially obtained by means of a print performed directly or indirectly on the substrate. However, the invention also applies to panels wherein the motif is realized in another manner, for example, by printing this motif on a carrier sheet and providing this carrier sheet on the aforementioned substrate, such as it is the case, for example, with DPL (Direct Pressure Laminate) laminate panels.

2. Related Art

Such panels are known as such, for example, from U.S. Pat. Nos. 1,971,067, 3,173,804, 3,554,827, 3,811,915, WO 01/48333, WO 01/47724, US 2004/0026017, WO 2004/042168, EP 1 872 959, DE 197 25 829 C1 or DE 195 32 819 A1. From the aforementioned documents, it is also known that the aforementioned material layers can comprise one or more priming layers, wherein these priming layers substantially extend underneath said print, and/or may comprise one or more finishing layers, which substantially extend above said motif. Such finishing layers may comprise, for example, transparent or translucent synthetic material layers, which form a protective layer above the, whether or not printed, motif and may comprise, for example, wear-resistant particles, such as aluminum oxide. It is not excluded that this protective layer comprises a material sheet, such as a paper sheet, which is provided, for example, with a synthetic material, such as an amino resin.

From the aforementioned patent documents, various methods are known for providing the surface of a coated panel with a structure. From the document WO 2004/042168, it is known to provide recesses in the substrate itself or in a priming layer and to perform a print in the form of a motif on this structured substrate. From WO 01/47725, U.S. Pat. Nos. 3,811,915 and 3,554,827, it is known to provide a lacquer-repellent means on the printed motif, such that the afterwards provided thereon transparent lacquer layer solidifies selectively, such that a structure is formed on the final panel. From WO 01/48333, it is known to provide impressions, with the assistance of a mould or press cylinder, in a lacquer layer provided above the motif. From WO 01/47724, it is known to provide a transparent lacquer layer by means of an inkjet selectively above the motif and in this manner realize a structure, wherein the thus provided lacquer layer covers the motif only partially and a portion of the motif is not protected against wear.

From DE 197 25 829 C1, it is known to provide impressions, by means of a mold or press cylinder or press plate, in a protective layer applied above the motif. In DE 197 25 829 C1, namely protective layers are used, applied in liquid form, which comprise thermo-hardening resin, such as melamine.

In respect to flexibility and/or in respect to structures to be realized, the herein above mentioned techniques leave much to be desired. For example, it is difficult to realize with these techniques, in a smooth manner, structures corresponding to the motif provided by the print. Moreover, according to some of the known techniques, the motif partially remains unprotected against, for example, wear or moisture penetration.

SUMMARY

According to its various independent aspects, the present invention in particular arms at offering alternative methods for manufacturing coated panels of the above-mentioned type, which, according to various preferred embodiments thereof, can be performed smoother and/or more economical than the methods from the state of the art, and/or offers a remedy for one or more disadvantages of the methods of the state of the art.

To this arm, the invention, according to its first independent aspect, relates to a method for manufacturing coated panels of the type comprising at least a substrate and a top layer with a motif, said top layer being provided on said substrate, wherein the method for realizing the top layer comprises at least two steps, namely, a first step, in which a synthetic material layer is provided on the substrate, and a second subsequent step, in which a relief is provided on the surface of said synthetic material layer, with the characteristic that said relief comprises a pattern of recesses and/or projections, wherein this pattern is at least partially determined by means of one or more prints. It is noted that between the substrate and said synthetic material layer, possibly still other material layers may be present, such as a layer representing at least a portion of said motif or the entire motif.

It is clear that according to this first aspect of the invention the relief only is obtained after the respective portion of the synthetic material layer already has been provided.

Thereby, for applying the synthetic material layer itself, techniques may be chosen which are appropriate for coating flat substrates, which considerably simplifies such method and thus limits the risk of forming undesired inclusions, such as air inclusions, in the synthetic material layer, or even excludes this risk.

Due to the fact that the pattern of the relief is at least partially determined by means of a print, a structure or relief corresponding to the motif can be applied simpler, smoother and more flexible. For example, the same printing technique may be applied both for forming the motif and for forming said one or more prints, such that possibly a similar resolution can be achieved in the motif and in the respective portion of the relief. Preferably, a print by means of a digital printing technique, such as inkjet printing, is applied. Of course, it is not excluded that printing techniques, such as offset printing or gravure printing, for example, by means of press cylinders, are applied.

It is noted that the color and/or tint of said one or more prints, which are responsible for the respective portion of the structure or the relief, possibly may remain visible at the decorative side of the final coated panel. In the case of a wood structure, in which the wood pores are imitated by a structure of recesses, in this manner the color and/or the tint of the wood pores can be realized.

The method of the first aspect can be realized in practice in a variety of possible manners. Below, four possibilities for this are discussed.

According to a first possibility, use is made of a print which is situated underneath said synthetic material layer and is applied, for example, in a step which is performed prior to or simultaneous with said first step. For example, one may work with a print by means of an expandable agent, which then, according to the invention, after applying the synthetic material layer, is expanded during said second step and in this manner deforms the synthetic material layer provided thereover.

During expanding, the synthetic material layer still may be soft or already completely or only partially solidified. When use is made of a not completely solidified synthetic material layer, this may also be solidified at the same time when forming the structure.

The expansion of the print may be initiated, for example, by supplying heat by means of an oven or radiation. Herein, the expansion possibly may be restricted by a mechanical molding element, which is brought into contact with the synthetic material layer, such that better defined structures can be achieved, which, amongst others, show less and/or smaller rounded portions. The use of such molding element may be of interest, for example, for forming chamfers at one or more edges of the panels concerned.

Instead of printing with an expandable agent, according to said first possibility printing may also be performed with an expansion-preventing agent, wherein this agent then locally counteracts a globally desired expansion. Such embodiment is of interest when a globally flat structure has to be formed, which needs to show recesses over a limited surface only. This may be the case, for example, when imitating wood structure, wherein the wood pores are present as recesses in a globally flat surface. Another example hereof is the formation of joints or chamfers.

Specifically, for example, as an expansion-preventing agent, for example, an agent can be applied which comprises benzotriazole and/or tolyltriazole. Such product is able to decrease or to prevent the expansion of a synthetic material, such as PVC. As an expanding agent, an agent can be applied which as such comprises PVC.

According to an ancillary possibility of said first possibility, said prints determining the structure are not only situated underneath said synthetic material layer, but also underneath said motif. According to this possibility, the motif itself obtains a structure, and depth-effects may be achieved.

According to still another ancillary possibility of said first possibility, the expanding or expansion-preventing agent is located in the motif and/or forms part of this motif. For example, such agent can be applied for realizing those portions of a motif which are intended for being present as a projection, recess, respectively, at the surface of the coated panel. So, the wood nerves and/or wood pores of a wood motif can be printed by means of a colorant or ink comprising an expansion-preventing agent.

According to a second possibility, use is made of a print which is situated above said synthetic material layer and is provided, for example, in a step following said first step. Such print may be performed, for example, with an agent which, whether or not after the activation thereof, is capable of forming recesses at the surface of said synthetic material layer. For example, an agent can be chosen which, possibly after its activation, locally may dissolve, erode, burn, melt or soften the synthetic material layer, such that at the location of the print, recesses may be formed in the synthetic material layer, possibly after rinsing away or otherwise removing the affected portion of the synthetic material layer.

According to another example of this second possibility, such print may be performed with an agent which, whether or not after the activation thereof, is capable of forming projections at the surface of said synthetic material layer. This may be realized, for example, in that the print as such already has a certain thickness and adheres onto the synthetic material layer, or in that the print comprises an agent which locally causes the synthetic material to expand or may prevent such expansion. Herein, this may be performed in a similar manner as in said first possibility, however, with the difference that the respective expandable or expansion-preventing agent now is situated above the synthetic material layer.

According to a third possibility of the first aspect of the invention, said print is applied for forming a structure on a transfer element or press element, such as a roll, wherein the thus at least partially structured transfer element then is applied for forming recesses in said synthetic material layer. Preferably, said structure on the transfer element is formed at the same time and/or in line with forming the recesses in the synthetic material layer. Preferably, it is the printed agent itself which forms the structure of the transfer element. For this purpose, for example, a wax or lacquer can be applied; also, agents comprising a metal, such as zinc or tin, are not excluded.

According to a fourth possibility of said first aspect of the invention, said print is applied for forming a mask on, in or underneath said synthetic material layer, wherein this mask enables a selective treatment of the synthetic material layer, for example, by means of a material-removing and/or material-depositing treatment, such that said mask determines the pattern of the thus obtained recesses and/or projections. Prior to said selective treatment, a selective curing treatment may take place by means of the same mask or a portion thereof. For example, by means of the mask, a selective UV or electron beam curing of a lacquer layer or other synthetic material layer may be obtained in a smooth manner. After having performed the treatment, the mask and the less solidified portion of the synthetic material layer may or may not be removed by means of any material-removing technique suitable therefor, for example, a technique in which the mask, possibly together with a not solidified portion of the synthetic material layer, is brushed off and/or suctioned off. According to preferred embodiments of this fourth possibility, examples of the further also mentioned fourth aspect of the invention are obtained. According to a subordinate possibility of this fourth possibility, the mask is formed by performing said print on a separate foil or material web or material sheet, wherein this foil preferably is made substantially transparent or translucent. Such foil, which is provided with a print, may be applied, for example, for selectively blocking UV or electron radiation, when it is applied between the synthetic material layer to be cured and the radiation source. It is clear that in the above text, by translucent or transparent is meant that these portions of the foil are permeable to the radiation which is applied when curing the synthetic material layer.

It is noted that a method, such as in the above-mentioned third possibility of the first aspect, wherein the structure of a mechanical press element is formed in line and/or at the same time with forming the recesses at the surface of a panel, as such forms a second independent inventive aspect of the invention, wherein the structure of the press element then is or is not obtained by means of a print. Such press element may be performed, for example, as a belt, a cylinder or a flat plate and may be composed substantially of metal, such as a steel alloy or a copper alloy, or substantially of synthetic material, such as silicone or melamine resin. Instead of by means of a print, the structure may be composed, for example, by means of material-growing or material-depositing techniques, such as selective laser melting or sintering, stereolithography, cladding and the like. According to still another possibility, use may also be made of material removal technologies, wherein then preferably a renewable material layer provided on the press element concerned is used, such that the structure of the press element can be produced several times. According to another possibility, the respective press element comprises a mechanism which allows altering the surface structure thereof. This possibility is particularly useful for forming larger impressions, such as impressions for joints, chamfers or bevels. By "at the same time and/or in line", it is meant that the press element on which the respective structure is formed, preferably at the same moment also is at least partially applied for forming a relief on the surface of a panel.

It is clear that the method of said second independent inventive aspect can be defined as a method for manufacturing coated panels of the type comprising a least a substrate and a top layer with a motif, said top layer being provided on this substrate, wherein the method comprises at least the steps of providing a synthetic material layer on the substrate and providing in this synthetic material a relief by means of a structured mechanical press element, characterized in that the structure of the press element is formed in line and/or at the same time with the step of providing a relief in the synthetic material. Preferably, another structure portion of the press element is applied when providing the relief in the synthetic material, than the one formed on the press element at the same moment. Preferably, a mechanical press element in the form of a belt or web is used, wherein this preferably performs a continuous movement, for example, in that this press element is transported along rollers, such as press rollers. A belt or web has the advantage that it may have a considerably larger surface than the surface of the coated panel. This allows maintaining a sufficiently large distance between the place where structure portions are formed and the place where other structure portions are brought into contact with the synthetic material layer.

The step of providing a relief in the synthetic material may be performed in various possible manners. According to a first possibility, the synthetic material is provided on the panel before the relief is realized in the synthetic material layer. According to a second possibility, the synthetic material also may be provided with the relief before the thus structured synthetic material layer is provided on the panel. So, for example, it is possible that the synthetic material layer is provided on an already structured portion of the press element and that the thus formed synthetic material layer is brought or transferred onto the panel. For example, one may substantially work with the method known as such from the document WO 2007/059967. In the method of this international patent application, a lacquer layer is provided on a structured material web, after which the thus formed synthetic material layer is transferred onto the panel, wherein a previously structured material web is used. According to the present aspect, instead of working with such previously structured material web, a material web structured in line and/or at the same time is used.

According to the invention, the structure portion formed in line and/or at the same time may be applied one or more times in order to provide the synthetic material with a relief. It is also possible that, in the case of re-using the press element concerned, the structure portions are formed again after this portion has been applied for forming the relief of one or more panels. Further, it is possible that the press element is intended for single use.

A method with the features of the second aspect generally has the advantage that a much larger variety of reliefs may be manufactured with the same press element. Moreover, it is possible to switch smoothly between different desired structures.

According to its third independent aspect, the invention relates to a method for manufacturing coated panels of the type comprising a least a substrate and a top layer with a motif, said top layer being provided on this substrate, wherein the method for realizing the top layer comprises at least two steps, namely, a first step, in which a synthetic material layer is provided on the substrate, and a second subsequent step, in which a relief is provided on the surface of said synthetic material layer, with the characteristic that said relief comprises a pattern of recesses and/or projections, wherein this pattern is at least partially obtained by locally increasing and/or decreasing the volume of said top layer and/or the substrate.

By "locally", it is meant that the entire top layer does not uniformly increase and/or decrease in volume. Herein, this may relate to very limited local variations in volume increase and/or decrease. For example, globally seen a uniform volume increase may be present at the surface of the top layer, whereas at the edges locally a lesser volume increase takes place, or even a volume decrease takes place, for forming lower-situated edges which may serve, for example, as an imitation of a joint, a chamfer or a sunken lacquer layer. According to another example, globally seen a uniform volume increase may be present at the surface of the top layer, whereas locally a lesser volume increase or a volume decrease takes place for forming recesses which imitate the presence of wood pores or other local unevennesses.

It is clear that according to the third aspect of the invention, the relief is obtained only after the respective portion of the synthetic material has been provided already. Hereby, for applying the synthetic material layer itself, techniques may be chosen which are appropriate for coating flat substrates, which considerably simplifies such method and limits or even excludes the risk that undesired inclusions, such as air inclusions, are formed in the synthetic material layer.

Further, it is clear that the possibilities mentioned in connection with the first aspect, where expandable or expansion-preventing agents are applied, also form examples of this third independent aspect. Such agents may be provided on the panel in any manner, whether or not by means of a print.

The volume increase of the third aspect can be obtained in any manner. For example, it may be created as a result of a chemical reaction, wherein a gaseous substance is formed in the top layer, which takes a larger volume than the actual matter of the top layer.

Preferably, the volume increase relates at least to an increase in volume of said synthetic material layer. Preferably, this synthetic material layer is situated above said motif and is made transparent or translucent. Preferably, the synthetic material layer forms the upper side of the coated panel. However, it is also possible that there are still further finishing layers on the synthetic material layer, such as one or more lacquer layers, whether or not comprising hard particles, such as aluminum oxide particles. It is clear according to the invention, the synthetic material layer also may be situated underneath said motif or may form part of this motif, wherein the layer thus may show any color.

According to a preferred embodiment of the third aspect, said increase or decrease in volume is performed in a controlled manner, for example, in that it is performed against a mold, such as against a structured flat press plate or against any other structured press element, wherein the structure of this press element relates to the negative or approximately the negative of a portion of the relief which is realized at the surface of one or more of the respective coated panels.

According to still another preferred embodiment of the third aspect, the relief formed by means of volume decrease or increase is finished with a material-removing and/or material-adding technique, such as laser milling or stereolithography.

According to the third aspect, it is also possible that the volume increase or decrease manifests itself at the surface of the substrate. Such embodiment may be obtained, for example, in that expandable material is present at the surface of the substrate or in this substrate. For example, the wood fibers in a layer at the surface of a MDF or HDF board may be provided with expandable material. According to a deviating variant of the third aspect, it is not necessary that the relief is realized after providing a synthetic material layer. By means of such inventive MDF/HDF or other wood-based board, effectively many new possibilities for manufacturing panels with structure are created. According to this deviating variant, the coated panel substantially may be obtained, for example, by performing the following steps in any desired sequence: locally expanding a wood-based substrate, for example, according to any of the herein also described possibilities for locally expanding or not expanding a synthetic material layer, providing a motif and possibly providing a protective transparent or translucent layer.

According to a fourth independent aspect, the present invention relates to a method for manufacturing coated panels of the type comprising a least a substrate and a top layer with a motif, said top layer being provided on this substrate, wherein the method for realizing the top layer comprises at least two steps, namely, a first step, in which a synthetic material layer is provided on the substrate, and a second subsequent step, in which a relief is provided on the surface of said synthetic material layer, with the characteristic that said relief comprises a pattern of recesses and/or projections, wherein this pattern is obtained by providing a mask on said synthetic material layer and subsequently performing a material-removing and/or material-depositing treatment on said synthetic material layer, wherein said mask at least partially determines said pattern.

Applying a mask for selectively adding material to said synthetic material layer and/or removing it therefrom leads to new possibilities for realizing a relief at the surface of a coated panel. For applying a mask, a printing technique, such as inkjet printing, may be used, wherein then also the characteristics of said first aspect of the invention are obtained, more particularly of the fourth possibility of this first aspect. Preferably, as a printing technique a similar technique is applied as the one which is applied for realizing said motif. In this manner, a mask corresponding to the motif can be realized in a simple manner, which mask then in its turn may result in a relief corresponding to the motif. Preferably, a printing technique is applied approximately having the same resolution as the printing technique with which the motif is realized, such that the finally obtained relief can be performed as finely as the motif.

It is clear that according to the fourth aspect of the invention, the relief only is obtained after the respective portion of the synthetic material layer already has been applied. Hereby, for the application of the synthetic material layer itself, techniques may be chosen which are suitable for coating flat substrates, which considerably simplifies such method and limits the risk that undesired inclusions, such as air inclusions, are formed in the synthetic layer, or even excludes that risk. However, the mask as such then possibly may be provided earlier than said material layer.

Preferably, said mask is composed or consists of a means which is resistant against said material-removing and/or material-depositing techniques, such that the respective technique indeed may be applied selectively on the places where the mask is not present or leaves an opening. The opposite is also possible, namely, that the respective technique is active only there, where the mask is present.

As a material-removing technique, for example, a chemical etching technique may be applied, which locally acts on the synthetic material layer, or a mechanical erosion technique, such as sandblasting or shot peening. It is also possible that for the material-removing technique at least a suction treatment is applied. This latter technique is ideally suited when the mask or a portion thereof is applied for selectively curing said synthetic material layer, wherein then preferably the portions of the synthetic material layer which are situated underneath the masking material are not solidified or solidified to a lesser extent.

As a material-depositing or material-growing technique, for example, stereolithography may be applied, or a spraying technique, such as injection molding, or an immersion technique, wherein then preferably material adheres there, where the mask is absent or is open.

According to the fourth aspect, the mask can be removed from the synthetic material layer after the relief has been realized. However, it may also be kept on the final coated panel and form part of, for example, the final relief or the final motif. As a material-depositing technique, also a technique may be applied wherein at least the mask is adhered permanently to the synthetic material layer. When the mask has to be kept at least partially in the final coated panel, the color of the mask may be attuned to the desired appearance of the decorative side of the final coated panel.

According to the fourth aspect, it is possible that the mask, instead of being realized on the panel, is made separately or, in other words, is performed as an entity existing as such. For example, it is possible that the mask comprises a separate foil or consists of it, wherein this separate foil or any other separate material sheet then preferably is made substantially transparent or translucent, however, is provided with masking portions, which resist said material-removing and/or material-depositing treatment, or in fact just provide for that the synthetic material, which is situated underneath the masking portions, is exposed to a larger extent to these treatments.

According to a particular embodiment, it is possible to provide a plurality of masks after each other and possibly one above the other. By means of this embodiment, it is possible to realize a larger variety of relief characteristics. For example, such technique may be applied for achieving deeper and/or three-dimensional structures. This technique also allows forming recesses and/or projections with oblique edges, and allows forming recesses and/or projections with a width-depth ratio, width-height ratio, respectively, which is smaller than 1 or is even smaller than 0.75 or less.

As is evident from several preferred embodiments of this fourth aspect, it is possible that between said first step, in which a synthetic material layer is applied, and said second step, in which a relief is applied at the surface of the synthetic material layer, at least an intermediate step is performed, wherein said synthetic material layer is at least partially cured. This curing preferably is performed selectively, and still better in a manner which is at least partially determined by a portion of said mask.

As already mentioned, substantially a difference can be made between two types of masks, namely, a first type, wherein the masking portions of the mask resist said material-removing and/or material-depositing treatment, and a second type, wherein the masking portions of the mask in fact provide for that the synthetic material situated underneath the masking portions is exposed to a larger extent to these treatments. Preferably, this latter may be realized by performing a curing of the synthetic material layer by means of the same mask, for example, by means of UV or electron beams, or by means of heat, wherein the masking portions then preferably form a screen for the radiation and/or heat concerned. In this manner, the less solidified portions can be exposed to a larger extent to the treatment which has to be performed afterwards, for example, a material-removing treatment.

It is evident that the material which is applied for realizing the masking portions of the mask of the fourth aspect must be adapted to the function required from them. For example, wax or paraffin may be used.

Preferably, said mask is formed in line and/or at the same time with the step of applying the relief in the synthetic material. Preferably, another masking portion of the mask is applied when forming the relief than the one which is formed at this same moment. Preferably, in this case a mask is used, which is performed as an entity made as an entity existing as such, for example, a mask in the form of a belt or web, wherein it preferably performs a continuous movement, for example, in that this mask is transported along rollers, such as press cylinders.

It is clear that the invention also relates to panels which are obtained according to a method with the characteristics of one or more aspects of the invention. Herein, this may relate, for example, to a coated panel of the type comprising at least a substrate and a top layer with a printed motif, said top layer being provided on said substrate, wherein said top layer also comprises a transparent or translucent synthetic material layer, which is provided above said printed motif, and wherein said synthetic material layer contains a foamable or foamed synthetic material. It is clear that such panel can be manufactured by means of a technique according to the first and/or the third aspect of the invention.

Preferably, said foamable synthetic material is chosen from the series of polyvinyl chloride, polystyrene, polyethylene, polypropylene, acrylate, polyamide and polyester. Preferably, said synthetic material layer substantially extends over the entire printed motif.

For the substrate of the coated panel of the invention, preferably use is made of a substrate which comprises a wood-based material, such as MDF or HDF.

Preferably, the coated panel relates to a panel, the motif of which relates to a printed motif, which preferably is obtained by performing a print directly or indirectly on said substrate.

It is clear that the coated panel which is obtained by means of a method with the characteristics of the invention, at its surface shows a relief which is obtained by means of a technique according to one or more of the aspects mentioned herein above and/or below.

According to another particular fifth independent aspect, the invention relates to a method for manufacturing coated panels of the type comprising at least a substrate and a top layer with a printed motif, said top layer being provided on said substrate, wherein the method for realizing the top layer comprises at least two steps, namely, a first step in which a synthetic material layer is provided on the substrate, and a second step in which a relief is provided on the surface of said synthetic material layer, characterized in that said relief comprises a pattern of recesses and/or projections, wherein this pattern is at least partially determined by means of a digital technique. It is noted that according to this aspect, said second step does not necessarily have to be performed after said first step and that the synthetic material layer does not necessarily have to be provided on the substrate already when the relief is realized at the surface thereof.

It is clear that the print of the first aspect as well as the mask of the fourth aspect may be obtained by means of a digital technique, for example, in that they both comprise a print which is provided with an inkjet printer. Therefore, such embodiments of the first and/or the fourth aspect also form examples of the present particular fifth independent aspect.

In general, according to the present particular aspect, it is preferred that the digital technique is applied for providing a mask, whether or not being temporary, which determines at least a portion of said pattern, and/or for providing a synthetic material-repelling, lacquer-repelling, expanding or expansion-preventing agent, wherein this applied agent then determines at least a portion of said pattern.

Further, it is clear that said digital technique also may be performed on a transfer element or mechanical press element, wherein it then preferably is performed in line and/or at the same time with forming the relief. In this manner, also an embodiment of the particular second independent aspect already mentioned above can be obtained.

According to all aspects of the invention, said synthetic material layer preferably extends substantially over the entire surface of the substrate. In this way, a relief or structure may be obtained over the entire surface of the structure. Preferably, said synthetic material layer also extends in the finally formed coated panel over substantially the entire surface of the substrate. Thus, preferably, material of this synthetic material layer will remain present in the deeper structural portions of the top layer, too. In this manner, it is possible to obtain good protection for the motif.

It is noted that the synthetic material layer, which is mentioned in all aspects of the invention, preferably relates to a translucent or transparent synthetic material layer, which is situated above said motif and in this manner protects this motif against wear, at least to a certain extent. In this case, it is possible that the synthetic material layer forms the surface of the final coated panel. However, it is also possible that further finishing layers are provided on the respective synthetic material layer, such as, for example, a UV-hardening, electron beam-hardening or other lacquer layer, which preferably comprises hard particles, such as ceramic particles with an average particle size of smaller than 200 micrometers. Clearly, it is not excluded that the synthetic material layer is situated underneath the motif instead of there above, or is formed by the motif or a portion thereof, in which case it does not necessarily have to be translucent or transparent.

For the synthetic material layer itself, use can be made of synthetic material comprising amino resin, such as melamine resin, PVC (polyvinyl chloride), polyethylene, polypropylene, polyurethane or polystyrene.

Preferably, the method according to all aspects is applied for manufacturing coated panels, wherein said substrate thereof comprises a wood-based material, such as MDF or HDF. Such material may easily be provided with a flat grinded upper surface, such that possible unevennesses of the respective upper surface do not interfere with the structure or relief realized at the upper surface. In order to prevent such influence on the structure, use may also be made of priming layers comprising a filling material, with which possible unevennesses at the upper surface of the substrate then can be filled.

When, according to any aspect of the invention, a synthetic material layer, such as a PVC layer, is combined with a wood-based substrate, such as a MDF or HDF substrate, preferably an adherence layer is provided between the synthetic material layer and the substrate. Such adherence layer may consist, for example, of a material sheet, which along one side is provided with amino resin, such as melamine resin, and at the other side is provided with the respective synthetic material, for example, PVC. From melamine resin, it is known that it adheres well to wood-based substrates, such as MDF or HDF. Possibly, the motif already can have been printed on this material sheet beforehand.

Preferably, said motif, according to all aspects of the invention, relates to a printed motif, which preferably is obtained by performing a print directly or indirectly on said substrate. An indirect print may be obtained, for example, by printing on one or more priming layers already provided on the substrate. According to the invention, however, it is of course not excluded to work with a motif which is printed on a flexible material sheet, which material sheet then is or will be completely or partially provided on the substrate. Preferably, said motif has been obtained by means of a print by an inkjet printer with one or more print heads.

It is clear that the steps discussed in all aspects of the invention may be performed on larger boards, of which the final coated panels then are formed, for example, by subdividing these larger boards with a sawing machine, as well as to panels already showing the approximate dimensions of the final coated panels. For a fast reaction to an order, and for excluding redundant supplies, it is advantageous to realize the structure and/or the motif as late as possible in the manufacture. In such case, they are preferably provided directly on panels already having approximately or completely the dimensions of the final coated panels. In that same case, the respective panels also can already be provided with possible edge finishes, such as milled coupling means or other profiled edge parts. Of course, it is not excluded that such profiled edge parts are provided later during manufacture. Providing structure or relief panel per panel has the advantage that the risk that this structure disappears, for example, in that it is milled away or sawed away or is removed in another manner, is considerably reduced, even when this relates, for example, to relatively restricted structures situated on the edge of the panel, such as chamfers with a depth of less than 1 millimeter.

Preferably, the position of the relief or the structure, according to all aspects of the invention, is referenced to a final edge or a final corner point of the coated panel, whether or not this edge still has to be obtained. This preferred embodiment can be performed in the most simple manner when the substrates already have the respective final edge or corner point; however, it is not excluded that, even if the substrates do not yet have this final edge or corner point, still an alignment is performed in respect to the final edge or corner point to be formed, for example, in that other reference means are provided, which adopt a position which refers to the respective final edge or corner point. For example, the present preferred embodiment allows obtaining symmetrical structures, such as tile imitations or floor part imitations with a two- or four-sided lower edge, in a smooth manner, wherein then preferably the width of the lower edges, at opposite sides of the coated panels, is performed equal or approximately equal.

Further, it is clear that according to all aspects of invention preferably a structure is obtained which corresponds to said motif.

In general, it is noted that the relief, which is discussed in all aspects of the invention, also can be restricted in depth, such that in reality, it relates to a pattern of different gloss degrees. For example, by means of a technique according to the fourth aspect, wherein sandblasting is applied as a material-removing technique, matte places can be realized at the surface of the coated panel. Further, it is also noted that the relief preferably is tangibly present at the surface of the final coated panel. However, according to certain embodiments, it is not excluded that the respective relief is present internally in the top layer of the coated panel and is not tangible, though visibly present at the surface of the coated panel. Such embodiment can be obtained when by means of the techniques of the invention a relief is imparted to the motif itself, whereas the surface of the coated panel as such is made substantially or entirely flat. As already mentioned, by such relief depth effects may be obtained, which remain visible at the surface of the coated panel. Other visible effects, which are not tangibly present at the surface of the coated panel, are not excluded.

BRIEF DESCRIPTION OF THE DRAWINGS

With the intention of better showing the characteristics of the invention, hereafter, as an example without any limitative character, some preferred embodiments are described, with reference to the accompanying drawings, wherein:

FIG. 1 schematically represents some steps in a method with the characteristics of the invention;

FIG. 2, at a larger scale, represents a cross-section according to the line II-II indicated in FIG. 1;

FIGS. 3 to 6, at the same scale, represent cross-sections, respectively according to the lines III-III, IV-IV, V-V-, VI-VI indicated in FIG. 1;

DESCRIPTION OF EXAMPLE, NON-LIMITING EMBODIMENTS

Figure 6:
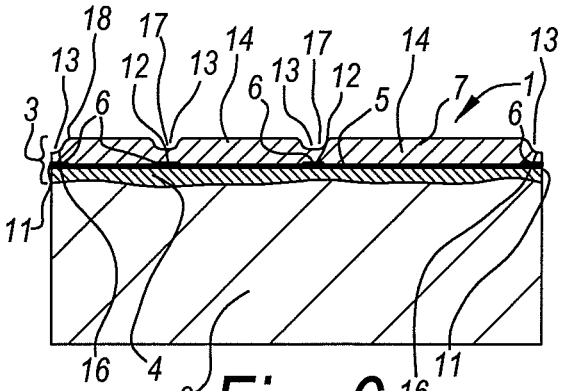

FIG. 1 schematically represents some steps S1-S5 in a method for manufacturing coated panels 1. The respective coated panels 1 are of the type comprising at least a substrate 2, for example, a MDF or HDF basic panel, and a top layer 3 provided on this substrate 2. In the example, the top layer 3 is composed of a plurality of material layers 4-7, amongst which a material layer 5, which shows a motif and which, during step S2, is applied in the form of a print 8 performed directly on the substrate 2.

In a previous step S1, one or more priming layers 4 are provided on the surface of the substrate 2 to be printed with the motif. These layers may have the purpose of providing a smooth subsurface and/or providing a uniform or quasi-uniform background color and/or an adhering undercoat for material layers 5-8 to be applied later, such as for the material layer 5 with the motif, or for the synthetic material layer 7.

FIG. 2 represents the result of step S1 and shows that a possible uneven surface of the substrate 2 can be made flat or approximately flat by means of said one or more priming layers 4.

In the example, in step S1 use is made of an application technique by means of one or more cylinders 9. It is clear that in step S1 of FIG. 1, also other application techniques may be applied for realizing one or more priming layers 4. At the same time, it is clear that it is not necessary for the invention that such priming layers 4 are applied, although this may be important for the quality of the motif. Instead of working with a priming layer 4 which is provided in liquid form, use may also be made of a priming layer 4 comprising a material sheet, such as a paper sheet, and which is provided on the substrate 2 in dry or quasi-dry form.

As aforementioned, in step S2 of FIG. 1 a motif is realized by means of a print 8 which is performed directly on the substrate 2 or on a priming layer 4 already provided on the substrate 2. The obtained motif relates to a wood motif extending over the entire length of the oblong rectangular panel 1. Of course, the invention is not restricted to such motifs.

In this case, for providing the printed motif use is made of an inkjet printer 10 with one or more heads. For example, use can be made of the techniques and devices which are known as such from EP 1 872 959, wherein, for example, such a battery of inkjet print heads is arranged one after the other and next to each other that the entire surface of the panel 1 can be covered by means of a multi-color print. It is evident that the present invention for step S2 neither is restricted to inkjet printing techniques, nor to motifs printed directly on the substrate 2.

FIG. 3 represents the result of the print 8 performed directly on the substrate 2, in this case on a priming layer 4 already situated on the substrate 2.

In step S3 of FIG. 1, an additional print 6 is provided above the printed motif. This relates to a print 6 with an expansion-preventing agent. The print 6 is performed with a pattern which will determine the final structure or the relief of the coated panel 1. Herein, the pattern covers only particular locations in the printed pattern and thus preferably does not extend over the entire surface of the final coated panel 1. In this case, the pattern forms a mask which provides the edges 11 of the panel 1 as well as certain locations 12 in the surface of the panel 1 with such expansion-preventing agent. Herein, the locations 12 in the surface of the panel 1 correspond to wood flowers or wood nerves present in the wood motif and will lead to recesses present in the final panel 1, which imitate wood pores.

FIG. 4 once again clearly shows the locations 11-12 of the print 6 provided in step S3.

In step S3, it is represented that the print 6, which determines the relief or the structure, is provided by means of a digital printing technique, such as by means of an inkjet printer 10. It is clear that it is not excluded that the print 6 or the expansion-preventing agent can be applied in another manner.

In step S4 of FIG. 1, a synthetic material layer 7 is applied. Such synthetic material layer 7 preferably consists of a transparent or translucent matter and preferably extends over the entire panel 1 concerned. In the example, a cylinder 9 is shown for applying such layer. However, it is clear that this synthetic material layer 7 can be provided in any manner. It is also possible that in step S4 a plurality of synthetic material layers 7 situated one above the other are applied, whether or not of the same kind. Preferably, also hard wear-resistant particles are provided in the synthetic material layer 7. For example, they may be blended or woven into the synthetic material or into the synthetic material layer 7 beforehand or can be strewn into the already provided synthetic material layer 7 or deposited in another manner.

FIG. 5 shows the result obtained after step S4.

In step S5 of FIG. 1, a relief is provided at the surface of the synthetic material layer 7 applied in step S4.

FIG. 6 represents that herein, a coated panel 1 is obtained which shows a pattern of recesses 13 and projections 14 at its surface, wherein this pattern is at least partially determined by means of the print 6 with expansion-preventing agent applied in step S3. This structure is obtained in that the synthetic material layer 7 is activated in step S5 and starts to expand. This activation may be obtained, for example, by heating the synthetic material layer 7 by means of a hot-air oven 15, an infrared oven or by radiation, such as UV or electron radiation.

FIG. 6 shows that at the places where in step S3 expansion-preventing or expansion-reducing agent is applied, said expansion has occurred to a lesser extent or not at all. At those places, there are recesses 13 in the surface of the thickened synthetic material layer 7. In this way, in the example chamfers 16 have been obtained at the edges 11 of the coated panel 1, and recesses 13 have been obtained in the surface of the panel 1 for imitating wood pores 17. It is evident that the technique of the invention may also be applied for obtaining chamfers 16 only or obtaining imitations of wood pores 17 only or for obtaining other structures.

FIG. 6 also shows that the obtained recesses 13 may have a structure with strong rounded portions 18.

Figure 7:
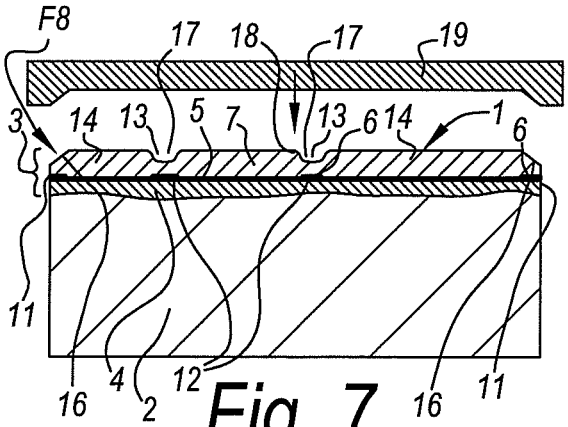
FIG. 7, at the same scale, but for a variant, represents a cross-section according to the line VII-VII indicated in FIG. 1.

FIG. 7 shows a possibility for obtaining sharper structures. Herein, when expanding the synthetic material layer 7, in step S5 a forming mold 19 can be applied, against which the expanding synthetic material layer 7 is rising. Such technique may be of interest for forming sharper chamfers 16. In the represented example, the forming mold 19 is a substantially flat press element. However, it may also be worked with one or more press cylinders or molding wheels.

Figure 8:
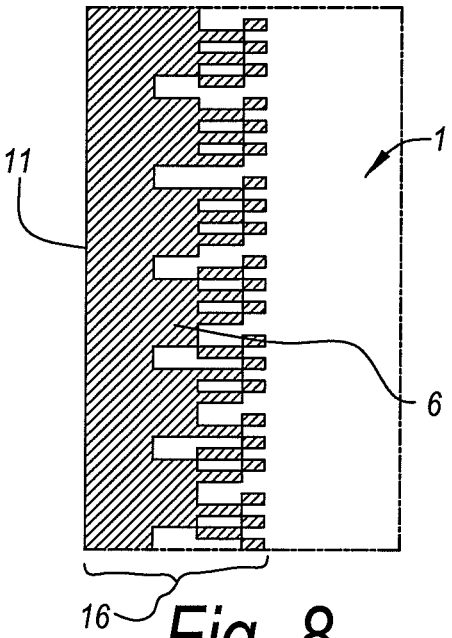
FIG. 8 for a variant represents a view according to the direction F8 indicated in FIG. 7.

FIG. 8 represents another possibility for obtaining sharper structures, such as sharp chamfers 16. Herein, the aforementioned one or more prints 6, which determine the structure, are performed with a so-called degrade, wherein the intensity or the amount of applied agent of the print 6 is varied according to the depth one wishes to obtain at that place. It is evident that this printing technique may or may not be combined with the technique represented in FIG. 7.

Applying such dégradé also has advantages in all aspects where the relief is at least partially determined by means of a preferably digital print.

It is clear that the method of FIGS. 1 to 6 and the variants of FIGS. 7 and 8 form examples of said first and third aspect, as well as of the last-mentioned particular fifth independent aspect.

Figure 9:
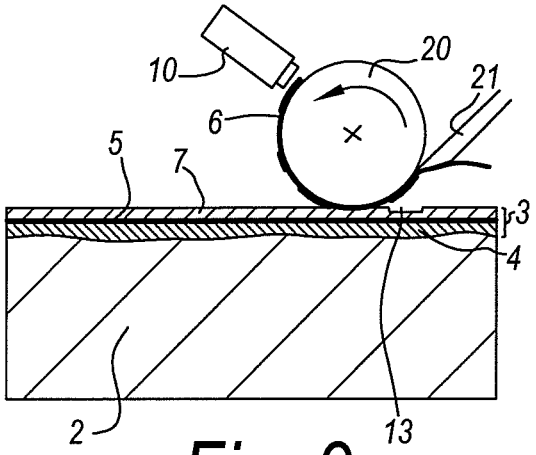
FIG. 9 schematically represents another method with the characteristics of the invention.

FIG. 9 represents a preferred embodiment of the invention with the characteristics of the first aspect. Herein, the third possibility mentioned in the introduction is applied for this purpose. Herein, by means of a print 6, a structure is formed on a transfer element 20, in this case on a cylinder. This structured cylinder is applied for forming the relief in the surface of the coated panel 1. Forming the print 6 on the transfer element 20 is performed in line and at the same time as forming the recesses 13 or the relief in the synthetic material layer 7 of the coated panel 1. For forming the structure on the transfer element 20, preferably a digital technique, such as a printing technique by means of an inkjet printer 10, is applied, wherein, for example, lacquer or wax is deposited in a pattern on the cylinder. Further, it is represented in FIG. 9 that the structure of the cylinder can be renewed continuously in that the already used structure portion of the cylinder is removed, for example, by means of a scraping device 21, and is replaced by a newly provided structure portion. It is clear that the example of FIG. 9 also shows the characteristics of both particular independent aspects mentioned in the introduction, namely of the second and the fifth independent aspect. Also, it is clear that also in such embodiment a degrade, as described by means of FIG. 8, can be applied.

Figure 10:
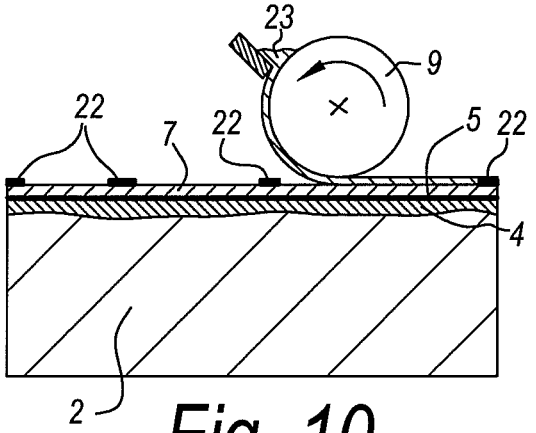
FIGS. 10 and 11 schematically represent some more steps in a method with the characteristics of the invention.

FIG. 10 represents another example of a method, wherein a mask 22 is provided on the synthetic material layer 7 and subsequently a material-depositing treatment is performed on the synthetic material layer 7. Here, the material-depositing treatment relates to coating the surface of the panel 1 by means of a liquid synthetic material 23. Herein, the mask 22 is chosen such that the synthetic material 23 solely adheres to those places where the mask 22 is not provided.

Figure 11:
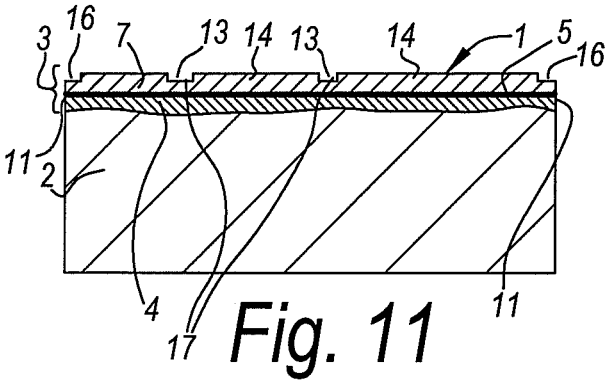

FIG. 11 shows the result of this method after the mask 22 and not the adhering portion of the synthetic material 23 has been removed. At the surface of the panel 1, a relief of recesses 13 and projections 14 is obtained. It is clear that this pattern is determined by said mask 22.

Further, it is clear that also when applying printed masks, it may be advantageous to apply so-called degrades, such as described by means of FIG. 8.

Figure 12:
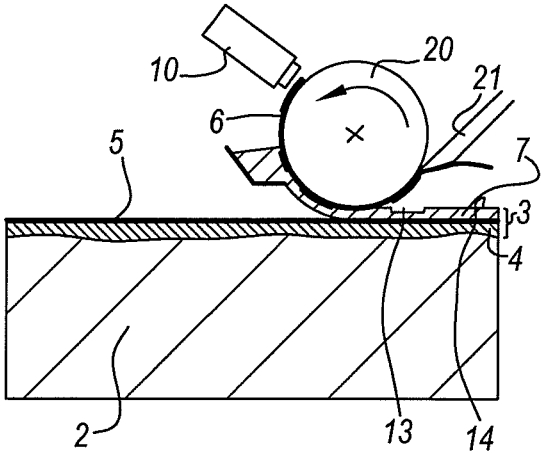
FIGS. 12 to 15 represent some more variants of a method with, amongst others, the methods of the second aspect.

FIG. 12 represents a variant of the method represented in FIG. 9, wherein the method comprises at least the steps of providing a synthetic material layer 7 on the substrate 2 and providing in this synthetic material a relief by means of a structured mechanical press element 20. Herein, the structure of the press element 20 is formed in line and at the same time with the step of providing a relief in the synthetic material. In the example, the press element 20 relates to a roller. The difference between the embodiment of FIG. 12 and the embodiment of FIG. 9 is that now the synthetic material is provided with the relief prior to providing the structured synthetic material layer 7 on the panel 1. Namely, the synthetic material is provided on an already structured portion of the press element 20 and the thus formed synthetic material layer 7 is at least partially transferred onto the panel 1.

Figure 13:
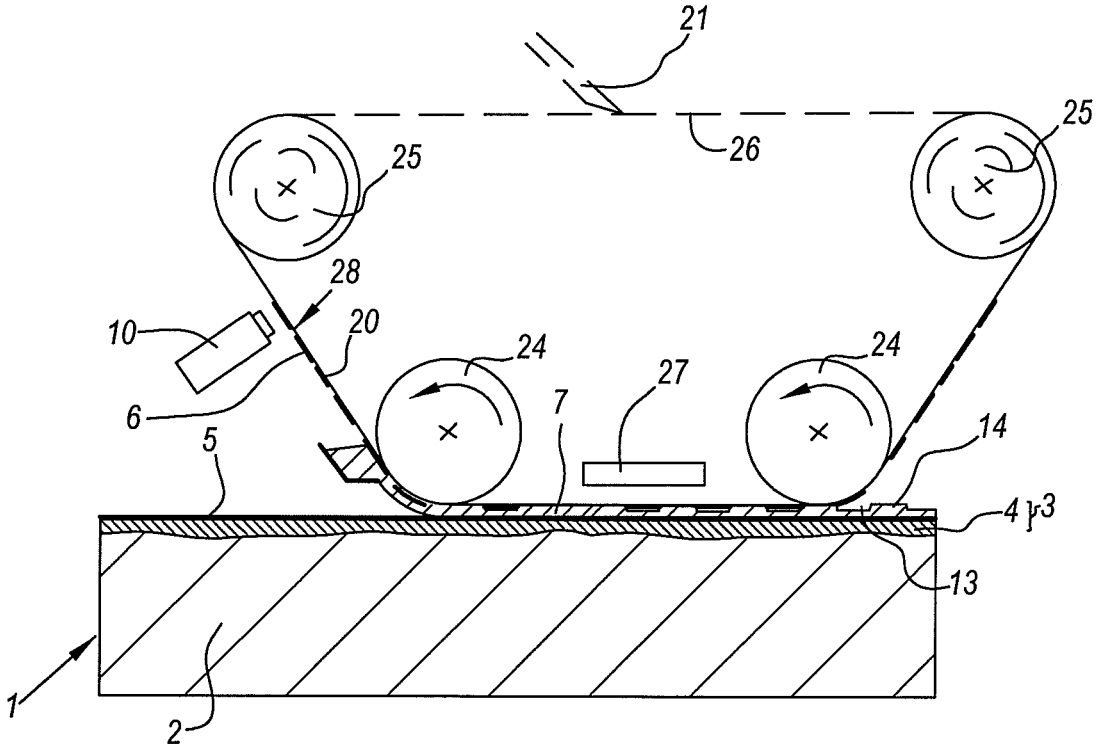

FIG. 13 represents another variant hereof, wherein for the press element 20 instead of a roller, a press belt or press web is used, which is transported over rolls 24 towards the panel 1. The press element 20 is of the type which can be provided on a supply roll 25. This may relate, for example, to a foil, such as a synthetic foil, a paper sheet or a metal sheet, such as aluminum foil. In dashed line 26, it is represented that one may also work with an endless belt, wherein then preferably also a scraping device 21 is provided, such that an already applied structure portion can be removed. In the case of such endless belt, for example, a metal belt may be used.

Of course, the arrangement of FIG. 13 may also be applied when, as it is the case in the example of FIG. 9, the synthetic material is provided on the panel prior to realizing the relief in the synthetic material layer 7. FIG. 13 also represents that it is possible to perform a forced drying on the synthetic material layer by means of any drying station 27. As a drying station 27, for example, a hot-air oven, a UV heating element or an infrared heating element may be applied.

It is noted that it is possible to structure the press element 20 of FIG. 13 at the other side 28 and obtain a similar effect. Such embodiment is not represented here, however, it has the advantage that the risk is minimized that the print 6 partially is also transferred onto the panel 1.

The arrangement represented in FIG. 13 corresponds to the arrangement represented in document WO 2007/059667, however, with the difference that instead of a previously structured material web, a press element 20 or press web structured in line and at the same time is applied.

Figure 14:
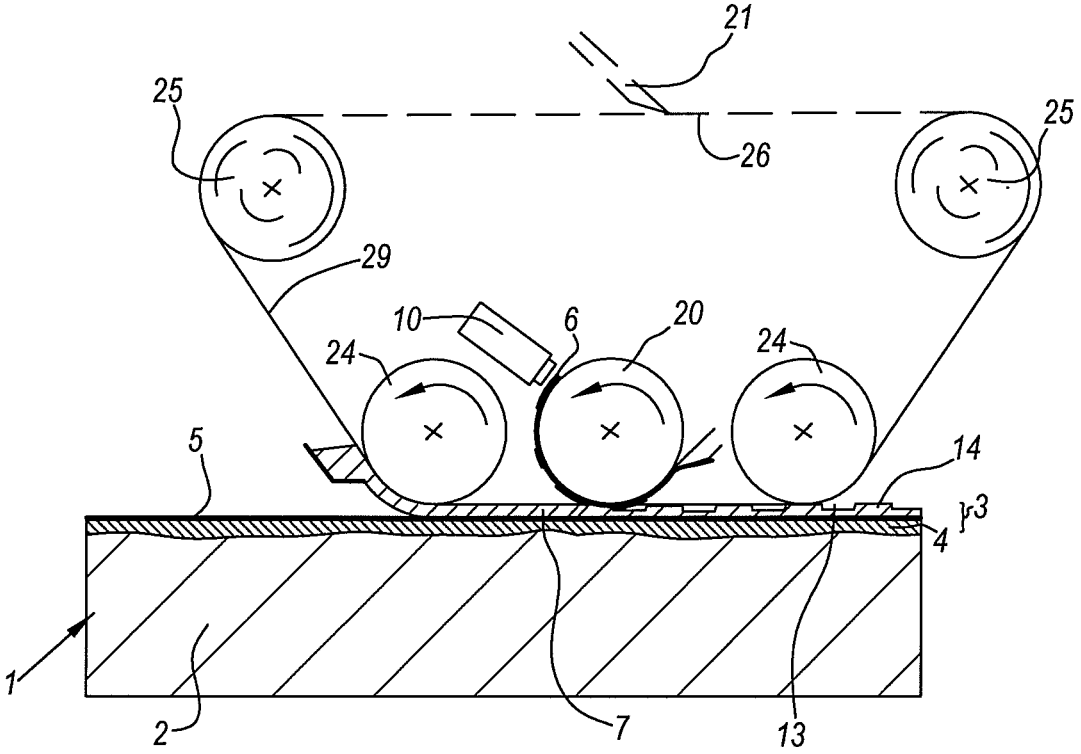

FIG. 14 represents another embodiment wherein this risk is minimized. Herein, substantially the process represented in FIG. 12 is applied, however, with the difference that a foil 29 is applied between the press element 20, which press element is structured in line and at the same time. This foil 29 is deformed by means of the structured press element 20, as a result of which a structure of recesses 13 and projections 14 is obtained in the underlying synthetic material layer 7.

It is also noted that the embodiments of FIGS. 13 and 14 have the advantage that only the web-shaped press element 20, the foil 29, respectively, come into contact with the synthetic material of the synthetic material layer 7. This is particularly advantageous when such synthetic material layer 7 comprises wear-resistant particles, such as aluminum oxide. In this manner, namely, the remaining parts of the arrangement, such as the rollers 24, are kept free from rapid wear.

Figure 15:
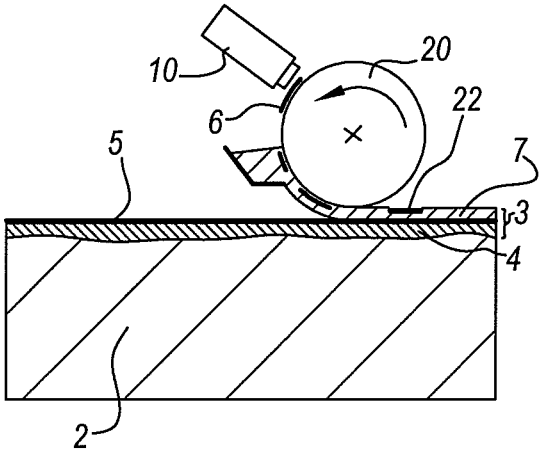

FIG. 15 represents another embodiment similar to the example of FIG. 12, wherein, however, the print 6, which determines the structure or at least a part thereof, is transferred onto the synthetic material layer 7. The technique of FIG. 15 possibly may be applied for forming a mask 22, which can be applied, such as described in the introduction in reference to the fourth aspect.

Figure 16:
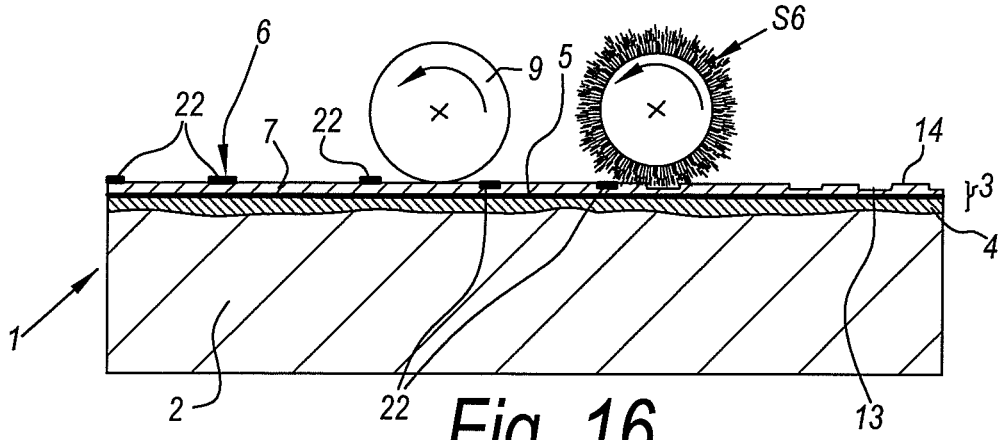
FIG. 16 represents another example of a method with the characteristics of, amongst others, the fourth aspect of the invention.

FIG. 16 represents another example of a method with the characteristics of, amongst others, the fourth aspect of the invention. Herein, a mask 22, which initially had been provided on the synthetic material layer 7, is printed into the synthetic material layer 7 by means of press treatment prior to applying said material-removing and/or material-depositing treatment. In this case, this relates to a material-removing treatment, namely, a brush treatment S6. Possibly, a drying treatment may be applied on the synthetic material layer 7 prior to said material-removing treatment, such that the actual synthetic material layer 7 is sufficiently resistant against this treatment S6. Such drying treatment is not represented here, however, may be understood as being similar to that of the drying station 27 of FIG. 13.

Figure 17:
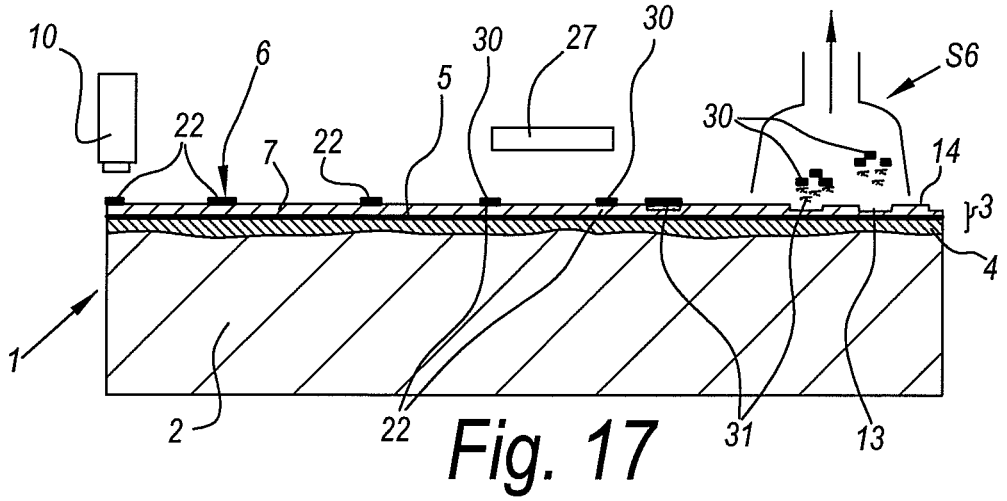
FIGS. 17 and 18 represent other variants showing, amongst others, the characteristics of the first and the fourth aspect.

FIG. 17 represents another example of a method with, amongst others, the characteristics of the fourth aspect. Herein, the mask 22 is of the type wherein the masking portions provide for that the synthetic material of the synthetic material layer 7, which is situated there underneath, is exposed to a larger extent to the material-removing treatment of the step S6, in this case, a suctioning treatment. In the example, this is realized in that the masking portions 30 comprise a material which is impermeable or at least offers a certain protection for the UV radiation of the drying station 27, such that the portion 31, situated there below, of the synthetic material layer 7 is solidified less or not at all. Those portions 31 of the synthetic material layer 7 then are removed in step S6, in this case, together with the mask 22, by means of the suctioning treatment represented here. It is possible that the mask 22 is removed in a separate step, preferably prior to removing the not or less solidified portions 31 of the synthetic material layer 7.

It is clear that the mask 22 from the example of FIG. 17 may be realized by means of a possible digital print 6, wherein then also an embodiment of the first and possibly the fifth aspect of the invention is obtained.

Figure 18:
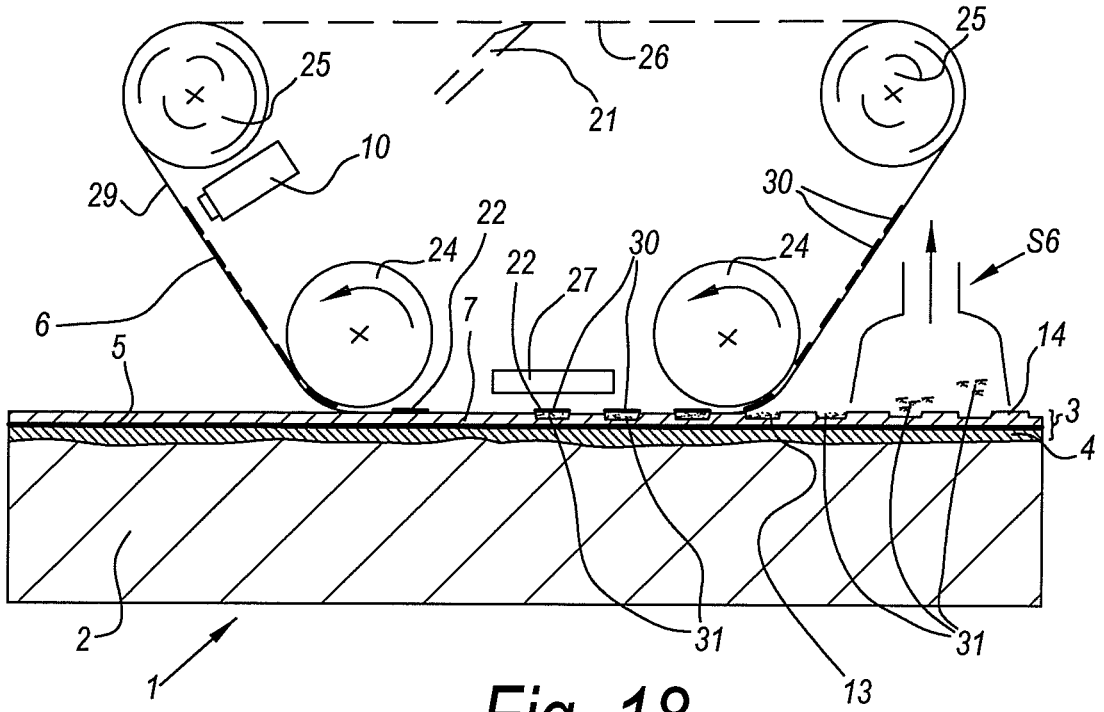

FIG. 18 represents an example in which a mask 22 is used, which is made as an entity existing as such. In this case, the mask 22 is composed of a substantially translucent or transparent foil 29, which, by means of a print 6, is provided with masking portions 30. In the example, this, as it is the case in FIG. 17, relates to masking portions 30, which provide for that portions 31 of the synthetic material, which are situated underneath the masking portions 30, are exposed to a larger extent to the material-removing treatment of the step S6, in this case, a suction treatment. This foil 29 is provided between the radiation source, in this case, the drying station 27, and the synthetic material layer 7 in a step preceding the material-removing treatment, at which location the masking portions 30 form a selective screen, for example, for UV radiation emitted by the drying station. FIG. 18 also represents an example of a method wherein the mask 22 is removed from the synthetic material layer 7 in a separate step. In this case, this is performed by moving the foil 29 away from the synthetic material layer 7 before the not at all or less solidified portions 31 are exposed to the material-removing treatment of step S6.

It is clear that the masking portions 30 may be provided on any side of the foil 29, or may even be provided on both sides thereof. The represented embodiment has the advantage that the masking portions 30 can be removed from the synthetic material layer 7 more simply. Possibly, the side of the foil 29 which is in contact with the synthetic material layer 7 may be provided with a release layer, for example, with a release layer comprising silicone and/or Teflon.

It is clear that the embodiments of FIGS. 17 and 18 also form an example of a method wherein the mask is formed in line and at the same time with the step of providing the relief in the synthetic material. Herein, then in fact another masking portion 31 is applied when providing the relief than the one formed at the same moment by means of the inkjet printer 10.

According to a not-represented variant, a plurality of masks 22 can be provided one after the other and/or above each other. In the example of FIG. 16, 17 or 18, a further mask 22 can be applied before or after an earlier mask 22 is printed into the synthetic material layer 7 by means of said press treatment, or after said mask 22 has been removed already. By a good choice of the various masks 22, recesses 13 and/or projections 14 may be realized with oblique walls and/or different depths.

It is clear that the results of the methods according to the invention depicted in FIGS. 6, 7 and 9 to 18 can be finished even further with one or more finishing layers, such as lacquer layers and the like.

It is noted that the thickness of the material layers and substrates represented in FIGS. 2 to 7 and 9 to 18 is represented only schematically and does not comprise any restrictions. However, it is clear that the thickness of the top layer can be restricted to several tenths of millimeters, whereas the thickness of the substrate may vary from 5 to 15 millimeters or thicker.

It is important to note that according to all aspects of the invention relatively rigid panels are manufactured and no coverings that can be rolled up. Rigid panels have the advantage that they can easily be provided with connection means, for example, screws, dowels or mechanical coupling means, which allow that two of such panels, for example, floor panels, can be coupled to each other, for example, by milling the profiles of such coupling means into said substrate. Such coupling means and milling techniques are known as such from WO 97/47834 or DE 20 2008 008 597 U1. Due to their rigidity and the presence of coupling means, the manufactured coated panels are simple to install and require no gluing to the underlying layer.

The present invention is in no way limited to the embodiments described above; on the contrary may such methods and panels be realized according to various variants, without leaving the scope of the present invention.

What is claimed is:

1. A method for manufacturing coated panels of the type including at least a substrate and a top layer with a motif, the top layer being provided on the substrate, the method comprising:

providing a synthetic material layer on the substrate; and providing a relief on the surface of said synthetic material layer provided on the substrate;

wherein the relief includes a pattern of recesses;

wherein the pattern is at least partially determined by at least one print;

wherein the print is applied by inkjet printing;

wherein the relief is obtained by printing a mask directly in the synthetic material layer;

wherein after providing the mask, curing the synthetic material layer;

wherein the mask provides for selective curing of the synthetic material layer, such that the synthetic material layer is not solidified or solidified at a lesser extent in correspondence of the mask;

removing the mask and the not solidified or less solidified portions of the synthetic material layer by performing a material-removing treatment on the synthetic material layer thereby obtaining the relief;

wherein the synthetic material layer is a translucent or transparent synthetic material layer that is situated above the motif;

wherein the motif is a printed motif that is obtained by performing a print directly on the substrate by an inkjet printer with one or more print heads; and wherein the coated panels are ceiling panels, floor panels, or furniture panels.

2. The method according to claim 1, wherein the mask comprises masking portions; and wherein wax or paraffin is applied for the masking portions.

3. The method according to claim 1, wherein the mask includes masking portions that are formed in line and/or at the same time with providing the relief in the synthetic material layer.

4. The method according to claim 1, wherein the selective curing is performed using UV or electron beams.

5. The method according to claim 1, wherein the material-removing treatment comprises at least a suction treatment.

6. The method according to claim 1, wherein the material-removing treatment comprises at least a mechanical treatment.

7. The method according to claim 1, wherein the material-removing treatment comprises rinsing away portions of the synthetic material layer.

8. The method according to claim 1, wherein the material-removing treatment comprises a chemical etching technique.

9. The method according to claim 1, wherein the material-removing treatment involves removing the mask.

10. The method according to claim 1, wherein the synthetic material layer is a translucent or transparent synthetic material layer that is situated above the motif.

11. The method according to claim 1, wherein the motif is a printed motif that is obtained by performing a print directly on the substrate by an inkjet printer with one or more print heads.

12. The method according to claim 1, wherein the motif and/or the relief are provided directly on panels already having approximately or completely the dimensions of final coated panels.

13. The method according to claim 1, wherein the relief corresponds to the motif.

14. The method according to claim 1, wherein the synthetic material layer comprises particles.

* * * * *